US008911517B1

(12) United States Patent
Young

(10) Patent No.: US 8,911,517 B1
(45) Date of Patent: Dec. 16, 2014

(54) COMPOSITION TO REDUCE PHASE SEPARATION IN AUTOMOBILE FUELS

(71) Applicant: Jeffrie C Young, Ada, OH (US)

(72) Inventor: Jeffrie C Young, Ada, OH (US)

( * ) Notice: Subject to any disclaimer, the term of this patent is extended or adjusted under 35 U.S.C. 154(b) by 0 days.

(21) Appl. No.: 14/068,117

(22) Filed: Oct. 31, 2013

Related U.S. Application Data

(60) Provisional application No. 61/720,638, filed on Oct. 31, 2012.

(51) Int. Cl.
*C10L 1/18* (2006.01)
*C10L 1/185* (2006.01)

(52) U.S. Cl.
CPC ..... *C10L 1/1852* (2013.01)
USPC ..... 44/443; 44/445; 44/447

(58) Field of Classification Search
USPC ..... 44/443, 445, 447
See application file for complete search history.

(56) References Cited

U.S. PATENT DOCUMENTS

| | | | | |
|---|---|---|---|---|
| 4,808,195 | A * | 2/1989 | Ambrogio | 44/445 |
| 6,183,525 | B1 * | 2/2001 | Jones | 44/443 |
| 6,767,373 | B2 * | 7/2004 | Jones et al. | 44/443 |

* cited by examiner

*Primary Examiner* — Cephia D Toomer
(74) *Attorney, Agent, or Firm* — Standley Law Group LLP

(57) ABSTRACT

An additive for gasoline, especially gasoline containing ethanol in an amount of up to about 15%, reduces the potential for phase separation of water from the gasoline. The additive has two components. The first component consists essentially of glycol butyl ether. The second component consists essentially of nonylphenol polyethylene glycol ether with minor amounts of polyethylene glycol and dinonylphenyl polyoxyethylene. Typically, the additive has the first component present in an amount in the range of from about 90 to about 95% by volume, with the balance being the second component. The additive is effective when added to the gasoline in an amount in the range of from about 0.52% to 0.63% by volume.

6 Claims, No Drawings

COMPOSITION TO REDUCE PHASE SEPARATION IN AUTOMOBILE FUELS

CROSS-REFERENCE TO RELATED APPLICATIONS

This application is a non-provisional of U.S. 61/720,638, filed on 31 Oct. 2012, and makes a priority claim to that application, which is incorporated by reference as if fully recited herein.

TECHNICAL FIELD

The disclosed embodiments of the present invention relates to a fuel additive, particularly an additive used to reduce phase separation of water from stored fuels, especially from fuels containing ethanol.

BACKGROUND OF THE ART

Many sources of fuel today contain some amount of ethanol, because of the oxygen content, which assists in reducing emissions. One fuel type commonly supplemented with ethanol is gasoline used in engines for machines such as vehicles, boats, planes, and other equipment. Ethanol has a natural affinity for water and if improperly stored, fuel comprising of ethanol-blended gasoline may absorb water potentially leading to phase separation. Phase separation occurs when the water present exceeds the amount that can be held by the ethanol. Once separated, the water in the fuel may freeze in fuel lines under freezing temperatures and lead to engine damages.

When phase separation occurs, there will be two or three distinct layers formed in the tank. Of these, the auto fuel will be the top layer, with a layer of water at the bottom. An intermediate layer, if present, will be an ethanol-water mixture, which will often be of a milky color.

Phase separation is temperature dependent. For example, an auto fuel with 10% ethanol ("E-10") can hold approximately 0.05% water at 60° F., which amounts to about 3.8 teaspoons of water per gallon of fuel. When the temperature drops to 20° F., the fuel can only hold about 2.8 teaspoons of water.

Phase separation can happen in an underground or an aboveground storage tank, a vehicle tank, a boat tank, in any type of equipment tank, and even in the gas can in your garage.

The position of a phase separation interface relative to the fuel pick-up point will determine the observed effect of the phase separation. If the pick-up tube is in the water layer, most likely the engine will fail to start. If the engine is running and suddenly draws water you can have damage from thermal shock or hydro-lock. If the pick-up tube draws ethanol-water mixture or just ethanol, the engine will operate in an extreme lean condition, which can cause significant damage or even catastrophic failure. Even if the pick-up tube draws the gasoline, it will operate poorly due to lower octane that is the result of no longer having the ethanol in the fuel.

Ethanol separation can also affect fiberglass fuel tanks, especially as seen in boats but before the early 1990s. Ethanol can attack the materials from which the tanks are made.

Another additive previously used in gasolines, methyl teriary-butyl ether ("MTBE"), has effectively been displaced by ethanol. This is due to its carcinogenic nature and its ability to pollute ground water in the event of a fuel spill or leak.

Before MTBE or ethanol were used as fuel additives, a low-molecular weight alcohol such as methanol or ethanol water commonly used to eliminate phase separation. Now that ethanol is already in the fuel, the effectiveness of that former It is therefore an unmet advantage to provide an effective phase separation reduction composition for use with ethanol-containing fuels.

SUMMARY OF THE INVENTION

This and other unmet advantages are provided by a composition for use in association with gasoline for reducing phase separation of water. The composition has two components. The first component consists essentially of glycol butyl ether, while the second component consists essentially of a mixture of nonylphenol polyethylene glycol ether, polyethylene glycol and dinonylphenyl polyoxyethylene.

In the composition, the first component is present in the range of 90 to 95% by volume with the second component comprising the balance.

In many embodiments, the nonylphenol polyethylene glycol ether is present in the second component at an amount of at least about 97% by weight, the balance being the polyethylene glycol and the dinonylphenyl polyoxyethylene.

The composition may be added to a gasoline fuel in an amount that makes it present in the gasoline in the range of from about 0.52 to about 0.62% by volume.

A method for reducing phase separation of water present in a gasoline for an internal combustion engine, comprising the step of: adding the composition to the gasoline, such that the composition is present in the gasoline in the range of from about 0.52 to about 0.62% by volume.

DETAILED DESCRIPTION OF A PREFERRED EMBODIMENT

An exemplary composition of the inventive concept is an phase separation reducer that is added directly to the fuel tank of the vehicle or device. In this type of application, the composition is added to the fuel in an amount of about 10 to 12 fluid ounces per 15 gallons of fuel, which nominally a full tank for a passenger vehicle. This amount represents a range from about 0.52 to about 0.62% by volume and will commonly be added at the time of a fuel fill up.

In another application, the composition is added to a bulk storage tank for the fuel. In this type of application, the composition is preferably added in the range of about 80 fluid ounces per 100 gallons of fuel in the tank.

A preferred embodiment of the composition comprises a mixture of two components.

The first component is an amount of GLYCOL ETHER EB, which is commercially available from a number of sources. The predominant compound present in the GLYCOL ETHER EB is glycol butyl ether, also known as ethylene glycol monobutyl ether, and identified by CAS Registry No. 111-76-20, as understood from Material Safety Data Sheets published by producers. The GLYCOL ETHER EB component is a high boiling liquid (bp 336 F) at room temperature and is miscible with water.

The second component is a commercially-available surfactant sold under the trademark TERGITOL NP-9 from The Dow Chemical Company. The predominant compound present in TERGITOL NP-9 is nonylphenol polyethylene glycol ether, also known as poly(oxy-1,2-ethanediyl), alpha-(4-nonylphenyl)-omega-hydroxy-, branched, identified by CAS Registry No. 127087-87-0. Additional compounds understood to be present, from Material Safety Data Sheets published by the producer, are polyethylene glycol (CAS Registry No. 25322-68-3) and dinonylphenyl polyoxyethylene (CAS 9014-93-1). The relative amounts, again as understood by disclosed MSDS data, are at least 97% by weight nonylphenol polyethylene glycol ether, less than 3% (by weight) polyethylene glycol and less than 2% (by weight) dinonylphenyl polyoxyethylene. TERGITOL NP-9 is a liquid at room temperature with a boiling point that exceeds 482 F, at which temperature the material decomposes. It is not generally miscible with water.

In a preferred embodiment of the additive, the first component is present in a range of from about 90 to about 95% by volume and the second component represents the balance.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A composition for use in association with gasoline for reducing phase separation of water, comprising:

a first component, consisting essentially of glycol butyl ether; and a second component, consisting essentially of a mixture of nonylphenol polyethylene glycol ether, polyethylene glycol and dinonylphenyl polyoxyethylene.

2. The composition of claim 1, wherein:

the first component is present in the range of 90 to 95% by volume with the second component comprising the balance.

3. The composition of claim 2, wherein:

the nonylphenol polyethylene glycol ether is present in the second component at an amount of at least about 97% by weight, the balance being the polyethylene glycol and the dinonylphenyl polyoxyethylene.

4. The composition of claim 1, wherein:

the nonylphenol polyethylene glycol ether is present in the second component at an amount of at least about 97% by weight, the balance being the polyethylene glycol and the dinonylphenyl polyoxyethylene.

5. An automobile fuel, comprising:

gasoline; and a composition according to claim 1, present in the gasoline in the range of from about 0.52 to about 0.62% by volume.

6. A method for reducing phase separation of water present in a gasoline for an internal combustion engine, comprising the step of:

adding a composition according to claim 1 to the gasoline, such that the composition is present in the gasoline in the range of from about 0.52 to about 0.62% by volume.

* * * * *